US006685371B1

(12) United States Patent
Holmberg

(10) Patent No.: US 6,685,371 B1
(45) Date of Patent: Feb. 3, 2004

(54) PRINTER ARRANGEMENT

(75) Inventor: Robert Holmberg, Lerum (SE)

(73) Assignee: Intermec IP Corp, Woodland Hills, CA (US)

( * ) Notice: Subject to any disclaimer, the term of this patent is extended or adjusted under 35 U.S.C. 154(b) by 0 days.

(21) Appl. No.: 09/914,021

(22) PCT Filed: Feb. 17, 2000

(86) PCT No.: PCT/SE00/00316

§ 371 (c)(1),
(2), (4) Date: Jan. 10, 2002

(87) PCT Pub. No.: WO00/48842

PCT Pub. Date: Aug. 24, 2000

(30) Foreign Application Priority Data

May 19, 1909 (SE) ..... 9901822
Feb. 17, 1999 (SE) ..... 9900553

(51) Int. Cl.[7] ..... B41J 29/02
(52) U.S. Cl. ..... 400/692; 400/693
(58) Field of Search ..... 400/691, 692, 400/693; 242/571, 572, 573.1, 573.2

(56) References Cited

U.S. PATENT DOCUMENTS 3,721,398 A * 3/1973 Azzalin et al. ..... 242/532.5
4,351,235 A * 9/1982 Bringhurst ..... 101/93.04
4,432,830 A * 2/1984 Jue ..... 156/384
4,560,292 A * 12/1985 Takahashi ..... 400/59
5,268,766 A * 12/1993 Nakadai et al. ..... 358/296
5,718,525 A * 2/1998 Bruhnke et al. ..... 400/586
5,973,711 A * 10/1999 Schartner et al. ..... 347/173
6,201,255 B1 * 3/2001 Torchalski et al. ..... 250/559.4

FOREIGN PATENT DOCUMENTS

JP 04029868 A * 1/1992 ..... B41J/15/04
JP 08300750 A * 11/1996 ..... B41J/11/14

* cited by examiner

*Primary Examiner*—Daniel J. Colilla
(74) *Attorney, Agent, or Firm*—Orum & Roth

(57) ABSTRACT

An arrangement for a printer, which printer comprises a chassis to which a print mechanism (3) as well as a feed mechanism comprising a print roller (4) are mounted for printing on and feeding of a printing material. The arrangement is characterized by said chassis comprising a central piece (1) in which said roller (4) is mounted only at one of its ends (12), whereby the roller (4) at its other end (11) is freely suspended in relation to the chassis.

27 Claims, 7 Drawing Sheets

PRINTER ARRANGEMENT

TECHNICAL FIELD

The present invention relates to an arrangement for roller suspension at a printer of a kind usable for printing and feeding of labels, tickets, receipts, luggage tags, etc. More particularly, an arrangement with overhung suspension of the rollers is intended. The invention comprises a design that contains few parts, resulting in lower costs for production assembly. With a low cost solution the design permits the feeding of paper to run perpendicularly to the chassis, and the design is furthermore open and easily assessable, simplifying service as well as usage.

BACKGROUND

A plurality of different printers are available on the market, intended for printing of a printing material in the form of labels mounted on a paper slip, or for example for printing of paper tickets. An often used design is a printer with through print and feed rollers, which rollers are anchored in both roller ends at the chassis of the printer. One of the problems with these printers is that they contain many parts, often many moving parts, resulting in a design were many thing can brake. A design with many and moving parts means extensive wear and entails difficulties with maintaining high precision. In earlier known designs, designed with outer bearings, bearing cages, strut beams, etc, high precision is required in the parts, alternatively extensive adjustments in order to obtain a paper feed perpendicularly to the chassis. The many parts in these earlier known designs make them expensive and difficult to access concerning inter alia service. Printer chassis traditionally have between six and seven parts, and they are not adapted to be used in different printer variants.

The present invention relates to a printer arrangement adapted to solve the problems mentioned above. An object of the present invention is thus to present a printer having few or variable parts.

Another object of the present invention is to obtain a printer with few force bearing points in order to minimize wear and to obtain high precision.

Yet another object of the present invention is to present a printer which is easily accessable for adjustment, exchange of parts and other service.

SUMMARY OF THE INVENTION

Accordingly, the invention relates to an arrangement for a printer, which printer comprises a chassis at which a printer mechanism as well as a feeding device comprising a print roller are mounted for printing on and feeding of a printing material. The invention is characterised in that said chassis comprises a central piece in which said roller is mounted only at one of its ends, whereby the roller's other end is freely suspended in relation to the chassis.

The arrangement preferably comprises a feed roller mounted with one of its ends in the central piece, parallel to the printer roller. The rollers are preferably rotatably mounted in the central piece of the chassis through bearings, which bearings preferably are slide bearings.

The central piece comprises an essentially flat portion with a first side and a second side, whereby said rollers project from the first side of the flat portion of the central piece. Furthermore, said central piece comprises recesses adapted to receive said rollers from said first side of the central piece, which recesses project from the second side of the flat portion of the central piece, and in which recesses the rollers are rotatably mounted through said bearings. The second side of the second piece is adapted for mounting of a motor unit for driving said rollers to rotation via a transmission, which transmission is adapted to act on said rollers at said recesses on the second side of the central piece.

The rollers preferably have rigid roller cores, and are mounted in said recesses in the central piece to a depth of at least 40% of the total length of the roller cores. Preferably each roller is mounted in said recess with at least two bearings, longitudinally spread apart along the extension of the roller.

Said rollers are, at the free roller ends, connected by a connecting device, which connecting device preferably comprises a snap-on lock for mounting at a recess around the axis of one of the rollers, and a bearing for the other axis.

In a preferred embodiment the central piece is cast in one piece, preferably die-cast.

In an embodiment of the invention the axis of the print roller comprises, at the end which is mounted in the chassis, a D-plane portion for mounting of a transmission wheel with a stop screw, which stop screw is eccentrically placed in relation to the axis of the roller.

In an embodiment where said central piece comprises an essentially flat portion with a first and a second side, said chassis further comprises a base plate for mounting of the central piece, a cover adapted to a least partly enclose the first side of the central piece, and a hatch adapted to at least partly enclose the second side of the central piece. Parts of the chassis are common for different printer variants, and other parts of the chassis are variable for adaptation to different printer variants. Preferably the common parts comprise the central piece and the cover, and the variable parts of the chassis comprise the base plate and the hatch.

The central piece preferably comprises recesses and mounting points for different printer variants, where said recesses and mounting points preferably are intended for mounting of rollers and suspension means adapted for different types and sizes of printing material.

The central piece is preferably cast in a magnesium material. Furthermore, the base plate and the hatch are preferably provided in different widths and/or lengths.

In one embodiment the printer further comprises unwind and rewind rollers for a colour ribbon, a sensor unit, printing mechanism and feed device comprising print and feed rollers, and a motor unit for driving said unwind and rewind rollers and print and feed rollers to rotation. Furthermore the central piece comprises recesses for a suspension means for a reel of printing material. Preferably the central piece comprises several recesses for the suspension means, for adaptation to different sizes of printing material.

In a preferred embodiment of the invention, the printer is adapted for printing of labels from a paper reel, whereby a paper rewind roller is mounted with one of its ends in the central piece. Said paper rewind roller is devised with a resilient shackle with shackle legs running parallel to the paper rewind roller on opposite sides thereof. Said shackle legs are preferably arranged with inwards projecting lips, and the paper rewind roller is preferably arranged with recessed portions, in size matching said projecting lips, said shackle being extendably anchored to the paper rewind roller with a built-in spring, whereby said projecting lips can be positioned into the corresponding recessed portions in a state where the shackle is extended a distance along the paper rewind roller. In one embodiment the unwind roller for the colour ribbon is arranged with a torsion spring clutch as a drag brake.

BRIEF DESCRIPTION OF THE DRAWINGS

The invention is described in detail below with reference to the accompanying drawings, of which.

DETAILED DESCRIPTION OF THE INVENTION

With references to the drawings a preferred embodiment of the invention is described below.

Figure 1:
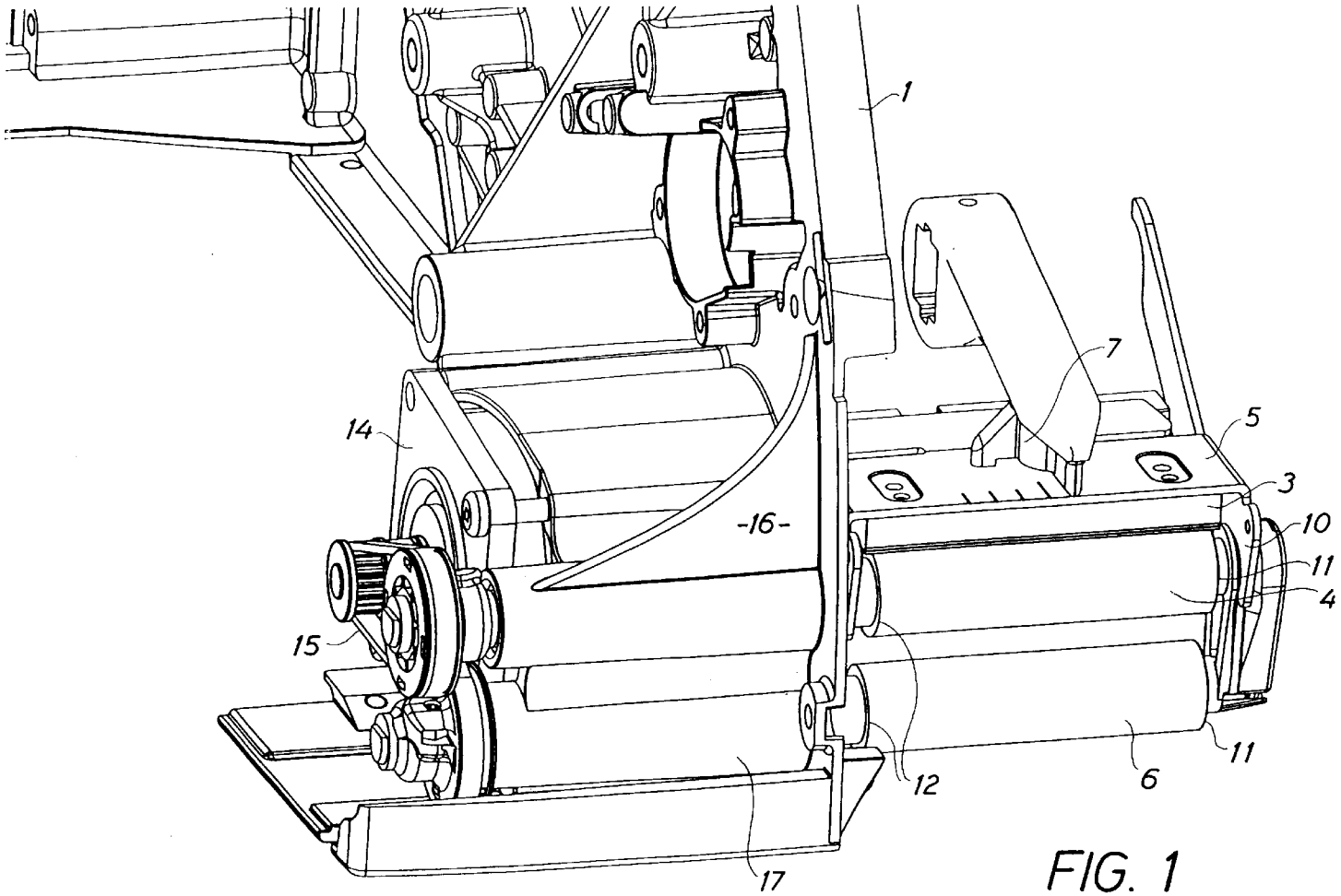
FIG. 1 is a perspective view taken at an angle from the front over a part of the second side of the central piece and a printer arrangement with overhung rollers according to the present invention.
Figure 2:
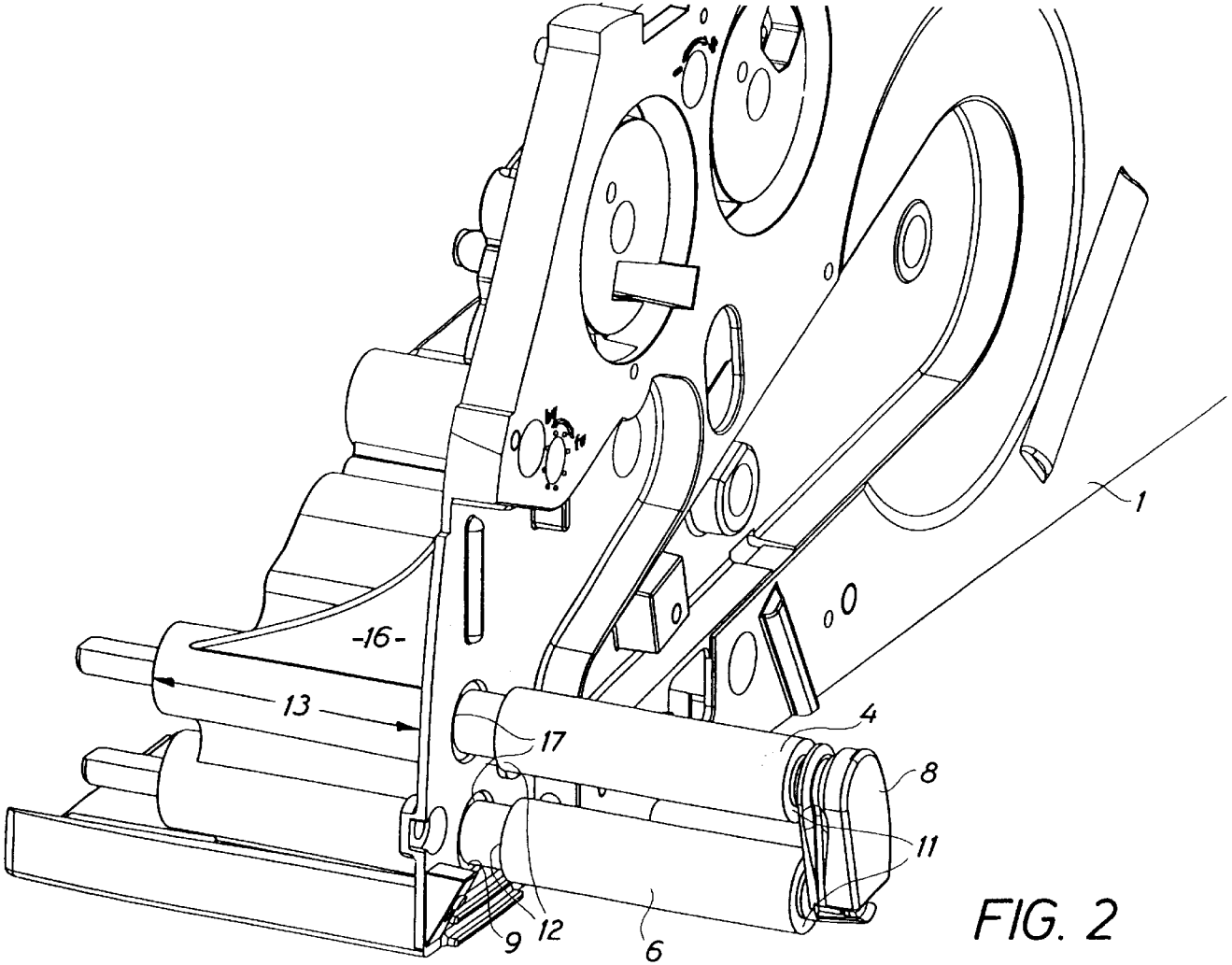
FIG. 2 is a perspective view taken at an angle from the front over a portion of the first side of the central piece, showing details around the overhung roller suspension.

The FIGS. 1 and 2 show the front part of a central piece 1 comprised in a printer chassis, at which central piece active parts for the printer are mounted. As is evident from FIG. 3, the central piece 1 comprises an upright essentially flat element with a first and a second side, which are provided with attachments and recesses for different parts comprised in the printer. By the first side is meant the one visible in the FIGS. 2 and 3, whereas the second side relates to the one illustrated in FIG. 1.

The central piece is placed centrally in the assembled printer. On its first side feeding of and printing on the printing material occur, which printing material can be for instance a paper reel or a label reel. For this purpose a printer head 3 with a holding device or main plate 5, as well as rollers 4 and 56 are arranged on first side of the central piece, which is evident from FIGS. 1 and 2. The upper roller 4, the print roller, co-operates with the printer head 3 through forks 10. The printer head is held in position through an arrangement with a magnet 7. The magnet 7 holds the main plate 5 and transfers pressure downwards when the printer is in the printing state, and pulling forces upwards when the printer is in an open state.

This arrangement with a magnet suspension of the printer head, and its function, is described more thoroughly in the patent application SE 9700417-0, which is hereby incorporated by reference.

When the printing material is used that is to be fed out entirely, for example tickets, the printing material is fed out off the printer directly by rotating the print roller 4. When printing labels which are adhered to a paper slip, the paper slip is rolled down around the feed roller 6, which is mounted under and parallel to the print roller 4. The label is thereby rolled off from the paper slip and is fed out off the printer, whereas the paper slip is fed back backward in the printer and is rewound on a rewind unit 37. This is described more closely below. At the central piece 1 is also, on its second side, a motor 14 arranged with a belonging belt transmission 15, as is obvious from FIG. 1.

Naturally the printer also contains a number of conventional details which are well known for a person skilled in the art and which are not explained in detail here. Referring to FIGS. 1 and 2, the roller suspension according to the present invention is shown. Rollers 4 and 6, i.e. a print roller 4 and a feed roller 6, are rotatably arranged in recesses 17 of the central piece 1 through bearings 9. These recesses 17 form channels projecting, essentially perpendicular, from the second side of the central piece. The rollers are thus only suspended on one side 12 of the rollers working portion, i.e. where the printing material is fed. The other end 11 is freely suspended without connection to any part of the chassis. The central piece is preferably a single die-cast central piece, and the bearings are preferably pressed in slide bearings. The bearings can be ball bearings, roller bearings, or other types of slide bearings. The central piece can for example also be made out of steel plate. The bearings can be arranged in pairs, at each end of the two channels 17. The bearings can alternatively be arranged along the entire length of the channels or arranged in other suitable ways. By correct shaping of the bearings the precision and stability of the printer design is controlled.

Rollers 4 and 6, which preferably are rubber rollers with rigid roller cores, are connected to each other by a connection 8. The rollers can for example be made out of steel. The connection 8 has the purpose of increasing the stability of the rollers and preferably comprises a simple plastic construction in order to protect the ends of the rollers and to guide the main plate. In a preferred embodiment the connection 8 is mounted to the feed roller 6 with a snap-on lock, grasping about a trace in the circumference of the feed roller 6 at its freely suspended end, and at the same time the connection 8 serves as a bearing for the print roller 4. Alternatively, a protecting element can be placed on each roller at the freely suspended ends.

The length or depth 13 of the channels 17 in the central piece 1 is mainly controlled by the overhung portion of the rollers. The longer the channel the more stable the design is, though also rendering a larger and more ungainly design. Preferably the depth of the channel is somewhat shorter than the length of the roller. Suitably, the length the rollers are inserted into the central piece is at least 40% of the length of the overhung portion of the rollers in order to avoid instability.

A stabilising strut 16 is cast in the central piece at the upper recess 17 for the print roller 4. In combination with the depth 13 of the channels, the strut 16 gives stability to the design. The strut 16 is uncritical.

In order to ease operation and service on the printer, the belt transmission is preferably placed facing upwards, as is evident from FIG. 1.

The roller suspension is here described as a preferred embodiment together with a printer with the magnet design as described in SE 9700417-0. The specific roller suspension according to the present invention can of course be used with an optional type of printer design.

The printer arrangement with a central piece 1 according to the present invention presents many advantages compared to prior arts printers. Due to the overhung roller design the printer has few parts, resulting in low costs for production and assembly. It gives an open and easily accessible design, thereby also being easy to access for repair of the print mechanism as well as the engine. The drive-motor 14 of the rollers can, as is evident from FIG. 1, be located in such a way that the transmission 15 between roller and engine faces outwards, whereby the drive-engine becomes easily accessible for assembly as well as service. This design also provides extra rigidity to the central piece, increasing the position for the printer as a whole. By the central piece being rigid, and thereby stable, high precision is obtained in the parallelity of the rollers as well as in the accuracy of the rollers perpendicular relation to the central piece. The central piece can, as earlier mentioned, be a single die-cast piece, which also increases stability and lowers production costs. Due to the slide bearings 9, which are pressed into the central piece, and a rigid roller core, a good parallelity is obtained between the rollers and a perpendicular relation between the central piece and the rollers.

Figure 4A:
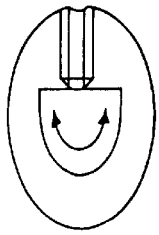
Figure 4B:
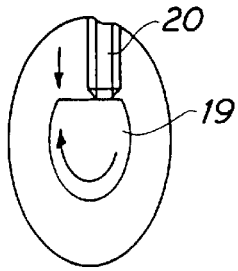

In FIG. 4 an alternative embodiment for mounting of cogwheels included in the transmission 15 onto the respective roller access 4 and 6 is shown. The cogwheels in a belt transmission are traditionally mounted on a "D-plane"-axis with a centrally placed stop screw according to FIG. 4*a*. In an embodiment of the present invention cogwheels in the belt transmission 15 are mounted on a "D-plane"-axis 19, which could be any of the axes of rollers 4 or 6, with an eccentrically placed stop screw 20 according to FIG. 4*b*. The advantages with this design is that the cogwheel is tightened to the axis by means of a torque, whereby the axis is not shaken loose as easily as with a traditional design where the stop screw is centrally placed.

The printer arrangement according to the present invention preferably comprises a variable chassis, where a part of the chassis is common for different printer variants and a part of the chassis is variable in order to be adapted to different printer variants. This design results in a printer chassis with few parts and parts that are variable and adjustable, giving great economical advantages.

A problem with earlier known label printer designs is that they comprise relatively many parts. The parts are normally also tailor-made for a special application, meaning that new and different parts have to be manufactured for each new printer variant that is developed. The present invention offers a design with as few parts as possible. Furthermore, the present invention offers a design made of a material that is light, and that is advantageous also from environmental and wear point of views.

According to a preferred embodiment of the invention all parts of the chassis, part from the base-plate, are cast in a magnesium material. Magnesium is a light material which is resistant to wear. Compared to plastics its considerable better both in terms of environmental aspects and wear aspects, and compared to aluminium, which also is light and a commonly used material, much easier to cast.

Figure 5:
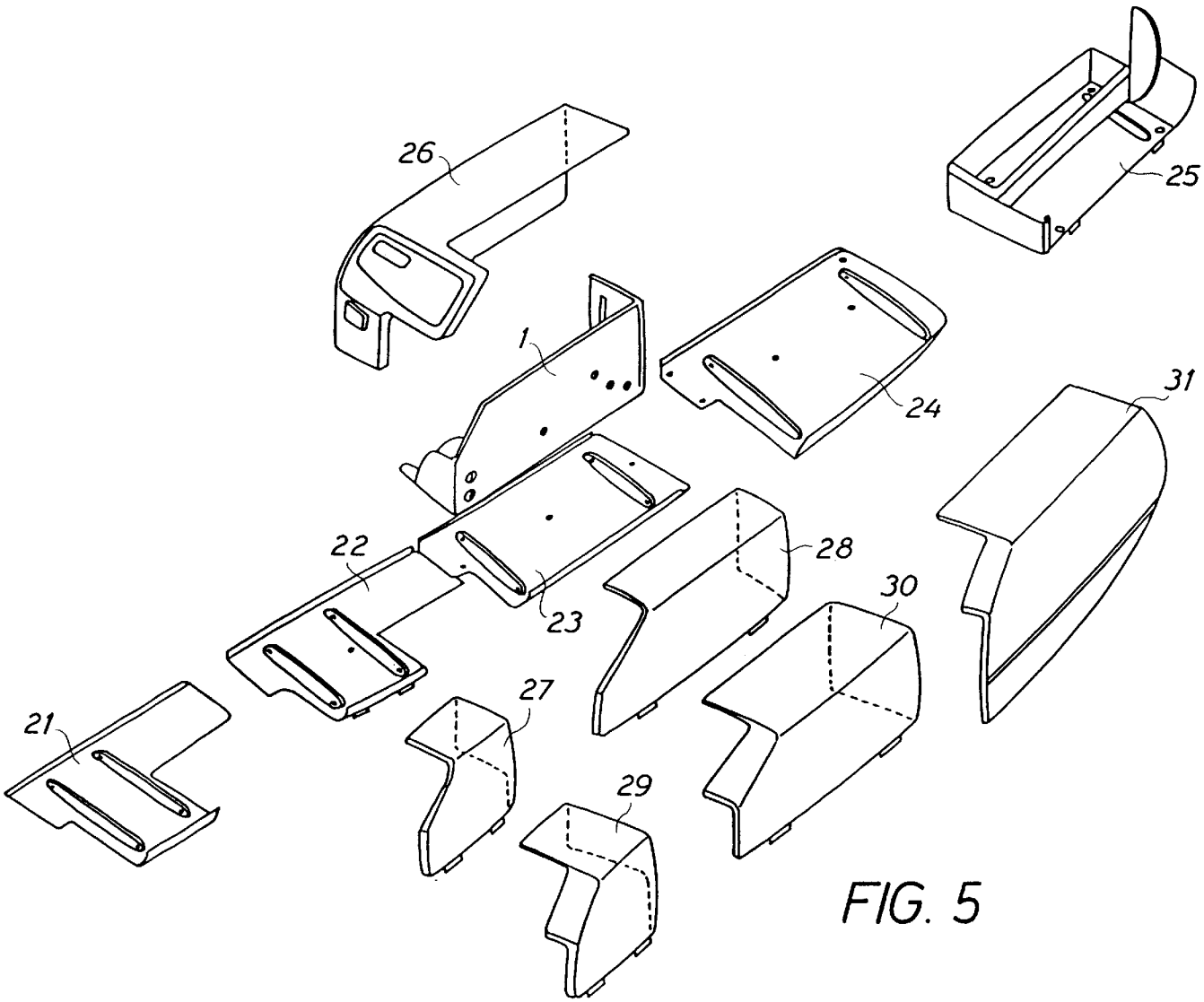
FIG. 5 shows comprised common and variable parts of the chassis for different printer types according to the invention.

In a preferred embodiment of the invention, shown in FIG. 5 the chassis comprises only 4 part: base-plate 21–25, central piece 1, cover 26, and hatch 27–31. The parts of the chassis which are common for different printer variants are the central piece 1 and the cover 26, whereas the parts of the chassis forming the variable part comprises the base-plate and the hatch. The base-plate can for instance be varied in two different widths 22, 23 and 21, 24, 25 respectively, and the hatch is then also varied with a narrow and a wide hatch 27, 28 and 29, 30, 31 respectively. The purpose of this is to adapt the chassis to different widths of paper-slips. The hatch can for instance also be provided in a short variant 27, 29, only protecting the prints head, and a long variant 28, 30, 31, also covering the paper reel. The short variant can for instance be applied when using a paper reel so large that is extends outside the outer dimensions of the printer. Alternatively the short variant can be used in the cases when the user for reasons of convenience doesn't want to have to take of the hatch for exchange of paper or adjustments. The two parts according to the preferred embodiments, which are common for different printer variants are the cover 26 and the central piece 1. In order to fit different printer variants the central piece has to be provided with recesses and attachments for all desired variants.

The central piece 1 is, as earlier mentioned, preferably cast in one piece, more particularly preferably cast in a single piece of magnesium-material for the reasons mentioned above. The base-plates 21–25 on the other hand is made out of steel plates in order to be extra rigid and durable. By the central piece 1 being formed in one piece it functions well as a heats transferring cold body. The heat that is generated by the different operating parts is efficiently transferred through the large cold body formed by the central piece.

An important thing to consider is transmitted electromagnetic radiation. This radiation may not be too high and there are well-stipulated levels to consider. For the purpose of achieving efficient attenuation of this radiation, side slits and ridges are formed in the cover. Through these slits and ridges the radiation is forced to zigzag and thereby an attenuation is achieved.

According to yet another preferred embodiment of the invention the cover 26 is provided with a circuit board for display and keyboard, whereby the mounting of the circuit board is especially adapted to be simple and easily exchangeable. Attachment is achieved thought notch attachment and columns with lock washers.

Figure 3:
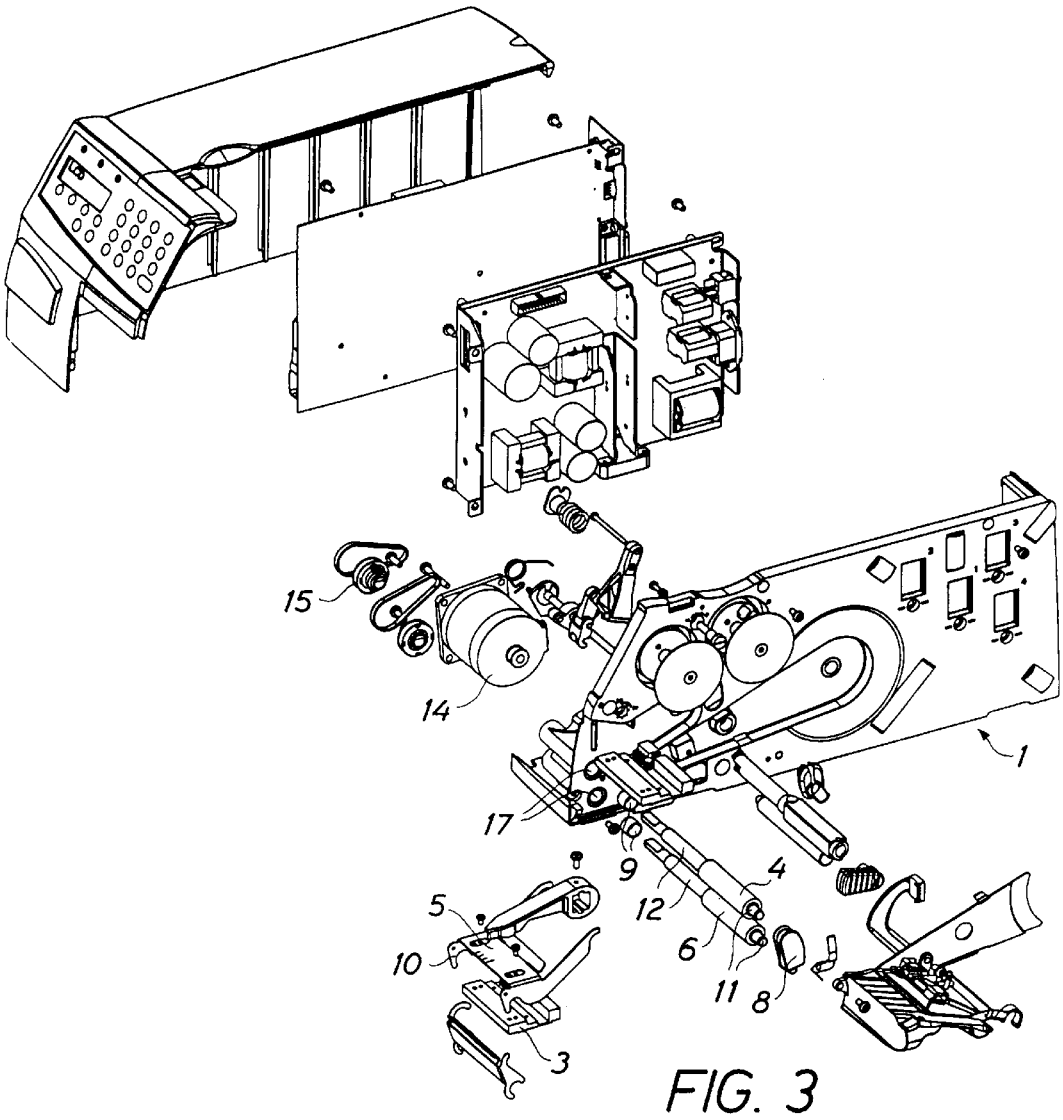
FIG. 3 is an exploded view of a printer with an arrangement according to the invention, FIGS. 4*a* and 4*b* schematically show an axis with a D-plane mounting for mounting of a cog wheel by means of a stop screw according to prior art and according to the invention.

The printer for the comprises a printing part with a print head and paper feed unit as has been described in connection with FIGS. 1–3, as well as rollers for unwind and rewind of colour ribbon, a dive unit with an engine, and an electronic unit for control of the printer.

In order to achieve high precision it is of high importance that all axes are parallel. The axes to the printer, evident from inter alia FIG. 3 are overhang, and a part from a paper roller axis they are all none rotating. Those axes that are to be driven, are driven through a cogwheel-belt arrangement, where by the center axis is fixed. The attachment of the axes is achieved by a snap-on lock as is evident from FIG. 7, in which the paper rewind unit is shown. The axis 32 is designed with a recess 41 in the circumference, with adapted clutches 34 formed on the roller 35. This provides a simple and secure fastening.

On the paper feed unit, comprising the roller 4, sensors are arranged: a transmitter on the upper side and a receiver on the lower side. The sensors sense the inter-space between the paper slips and transfers this as a signal to print head 3. The sensors are moved or adjusted by a step function. They are moved separately equally many steps. The paper feed unit operates by automatic input. The paper is fed into a funnel to the sensor, where after the sensor senses and starts the engine, which drives the printing material onwards to the next label inter-space.

Figure 6:
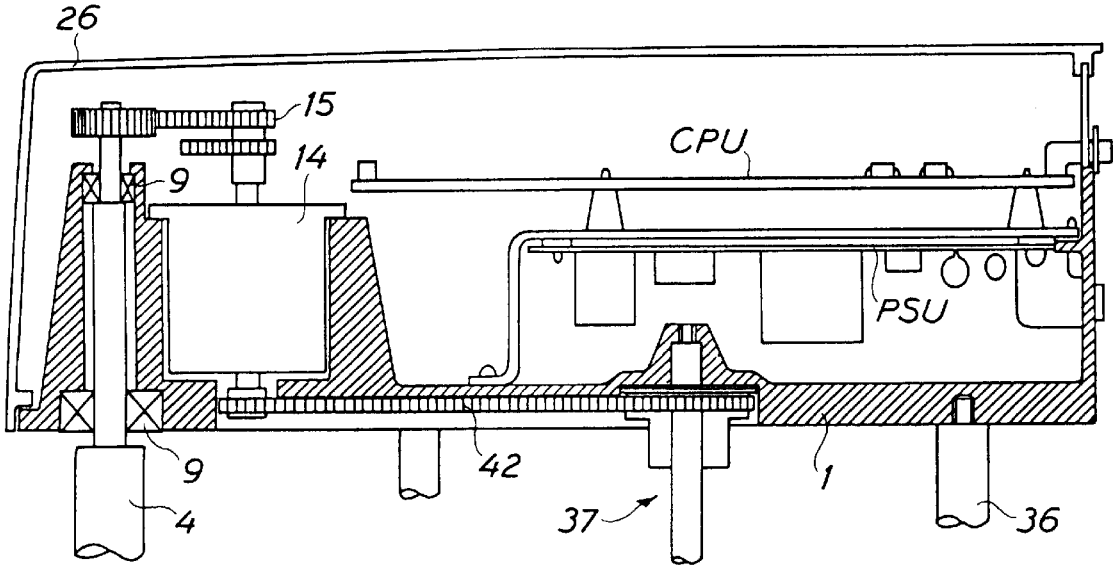
FIG. 6 is a sectional view taken from above of the central piece in a printer arrangement according to the invention.
Figure 7:
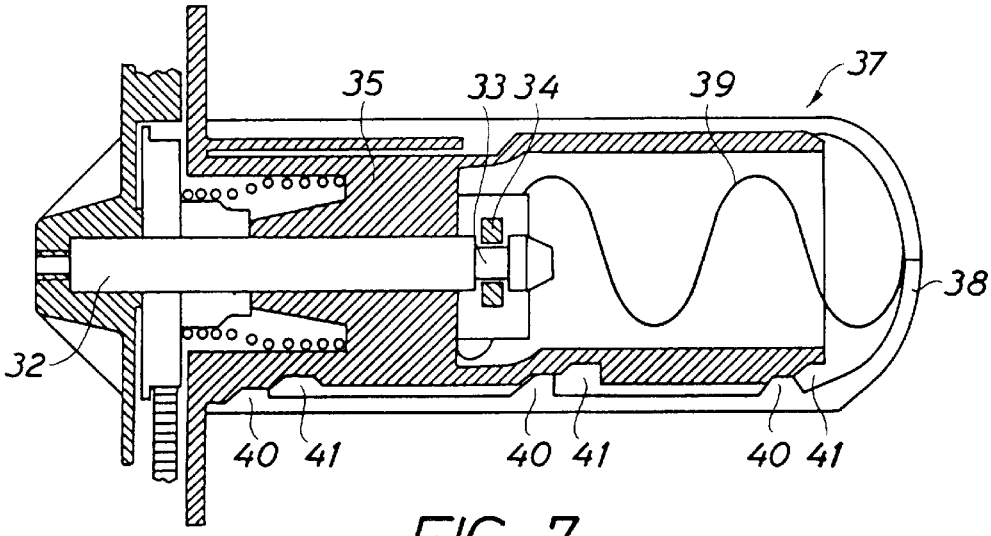
FIG. 7 is a sectional view taken from the side of a paper rewind unit according to the invention.

The parts for the unwinding and rewinding of paper are the holder 36, which is visible in FIG. 6, and the rewind unit 37 which is illustrated in FIG. 7. The holder 36 is intended to hold a paper reel to feed from. It comprises a holder—member and an attachment member, and is preferably a non-rotating holder. For attachment of the holder in the central piece the holder is provided with attachment clutches which fit and run in a recess in the central piece. The holder can be positioned in an upper and a lower position. The holder is fixed through a plastic screw. This way the load is achieved in the attachment member, not in the holder member.

The rewind unit 37 shown in FIG. 7 comprises a non-rotating axis 33, a slide brake, preferably a spring torsion clutch, a roller 35 and a plastic shackle 38 with a built-in spring 39. The plastic shackle runs about the axis and is provided with lips 40, which are adapted to recesses 41 in the axis. When the finished paper, from which the labels have been taken off, has been rewound on this unit 37, and is to be taken off, the plastic shackle 38 is extended a distance so that the lips 40 are pressed into the recesses 41 in the roller 35. The firmly rewound paper reel thereby loosens from the roller and is easily taken off. The plastic shackle 38 is provided with a built-in spring 39 in order for the shackle to return by itself after having been extended. The plastic shackle remains on the roller thanks to the lips, and due to the action of the built-in spring, which is extended when the plastic shackle is drawn out, the shackle is pressed back after the paper reel has been taken off. In FIG. 6 the central piece 1 is shown from above, whereby it is evident that the rewind unit 37 is also driven by the motor unit 14, through a belt arrangement 42. The belt cog wheels are preferably fixed to the engine axes by means of eccentrically placed stop screws according to FIG. 4*b*.

Figure 8:
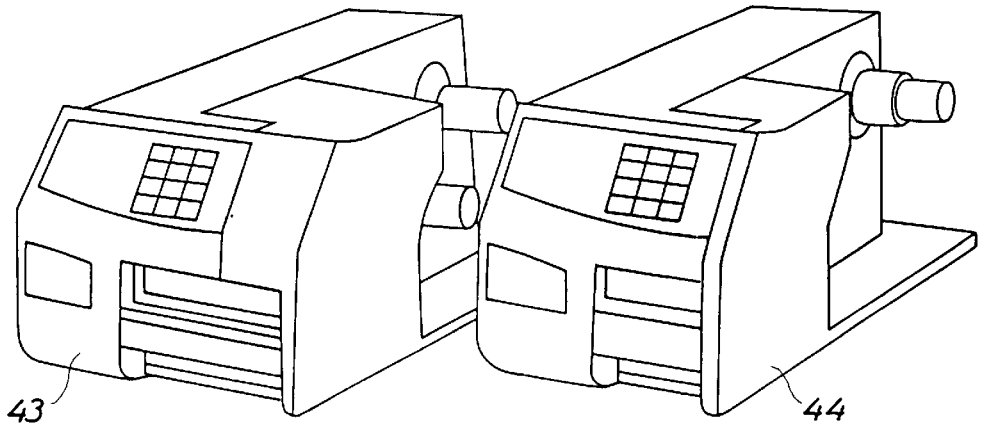
FIG. 8 shows two different printer types according to the invention, without hatch, adapted for different widths of printing material.

In FIGS. 8–11 different printer variants are shown, all being embodiments of the present invention. The design of the chassis with a common central piece 1 and cover 26, but with exchangeable base plates 21–25 and hatches 27–31, is very versatile and easily variable. In FIG. 8 two printer variants are shown, where printer 43 is adapted for wide printing material with base plate 24 and short hatch 29. Printer 44 has base plate 23 and short hatch 27. These printers 43 and 44 could also be assembled with base plates 21 and 22 respectively.

Figure 9:
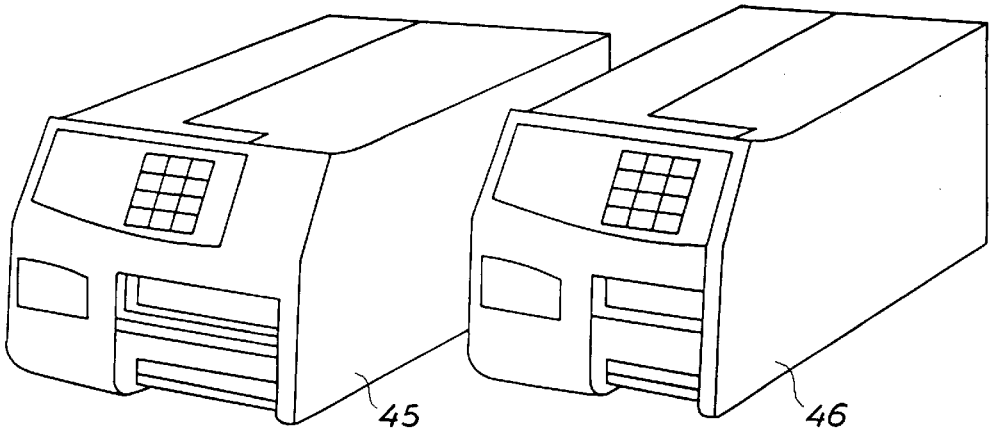
FIG. 9 shows two different printer types according to the invention, with hatch, adapted for different widths of printing material.

In FIG. 9 printer variants 45 and 46, are shown, having long hatches 30 and 28 respectively, but having the same base plates as in FIG. 8.

Figure 10:
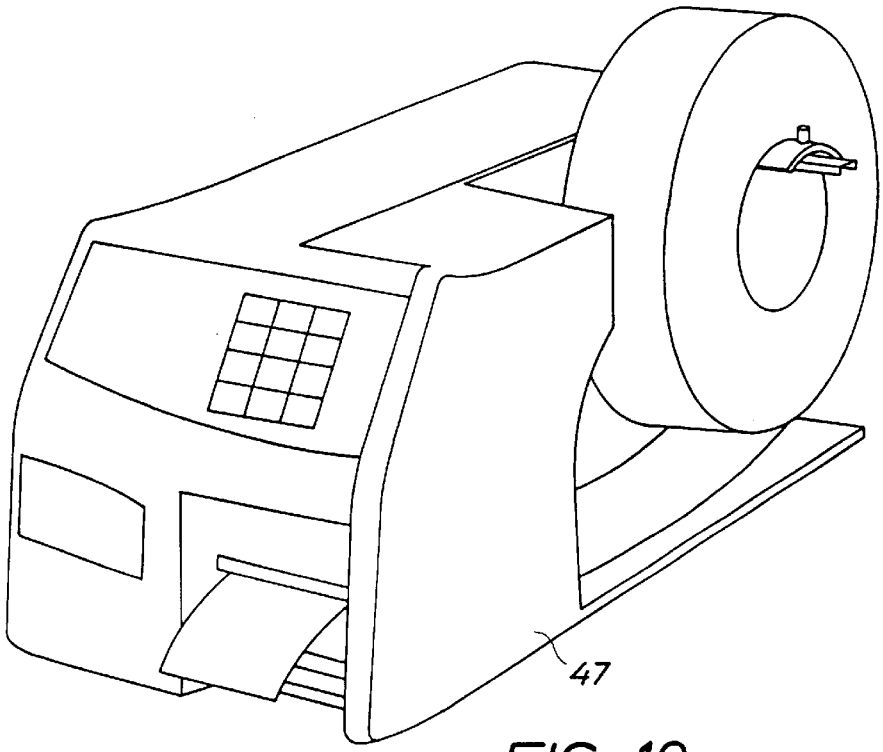
FIG. 10 shows a printer type according to the invention, without hatch, adapted for a large reel of printing material.

In FIG. 10 a printer variant 47 is shown for diametrically large but narrow paper reels. For the event one wishes to enclose such a large reel, base plate 25 and hatch 31 are needed.

Figure 11:
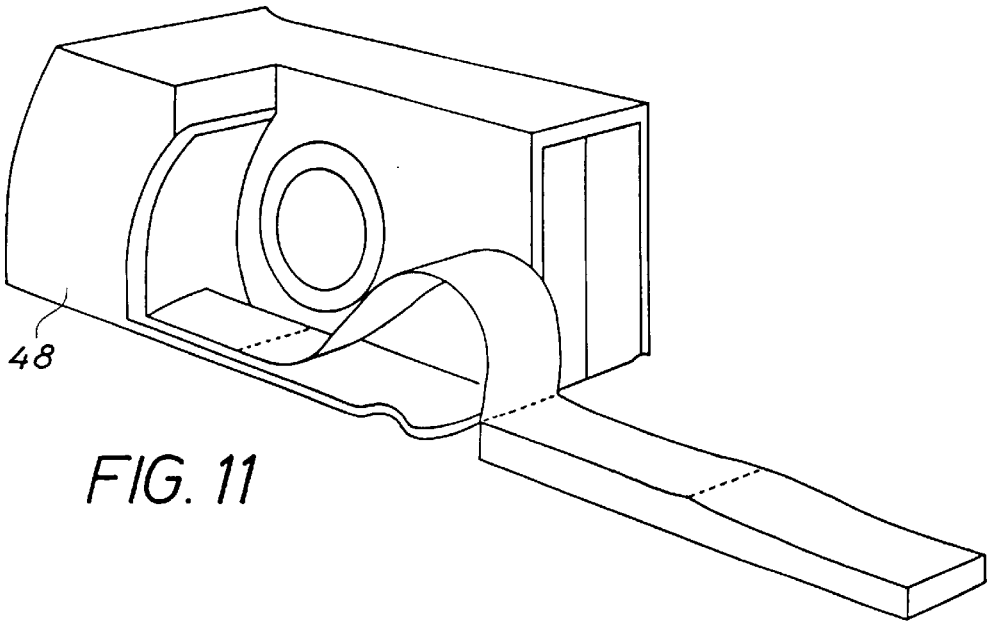
FIG. 11 shows a printer type according to the invention, without hatch, adapted for a printing material in a stack.

In FIG. 11 a printer variant 48 is shown, being adapted to collect printing material from a stack.

Embodiments of the invention that have been described in detail have only been chosen for illustrative purposes. A person skilled in the art realises that there are many alternative solutions to the invention. The scope of the invention is only limited by the subsequent claims.

What is claimed is:

1. Arrangement for a printer, which printer comprises a chassis to which a print mechanism (3) as well as a feed unit comprising a print roller (4) are mounted for printing on and feeding of a printing material, characterized in that said chassis comprises a central piece (1) in which said print roller (4) is mounted by one of its ends (12), a feed roller (6) mounted with one of its ends in the central piece (1) the feed roller is mounted parallel to the print roller (4), said rollers (4,6) are rotatably mounted in the central piece (1) of the chassis through slide bearings whereby the other end (11) of the rollers are freely suspended in relation to the chassis (1).

2. The arrangement according to claim 1, wherein said central piece (1) comprises an essentially flat portion with a first side and a second side, whereby said rollers (4,6) project from the first side of the flat portion of the central piece.

3. The arrangement according to claim 2, wherein said central piece comprises recesses (17) adapted to receive said rollers from said first side of the central piece, which recesses project on the second side of the flat portion of the central piece, and said rollers (4,6) are rotatably mounted in said recesses to said bearings (9).

4. The arrangement according to claim 3, wherein said central piece on said second side is adapted for attachment of an engine unit (14) for driving said rollers into rotation by way of a transmission (15).

5. The arrangement according to claim 4, in which said transmission (15) is adapted to act on said rollers (4,6).

6. The arrangement according to claim 5, wherein said rollers (4,6) comprise rigid roller cores.

7. The arrangement according to claim 6, where the rollers (4,6) are mounted in said recesses (17) in the central piece (1) to a depth of a least 40% of the total length of the roller cores (4,6).

8. The arrangement according to claim 7, wherein said bearings comprise at least two bearings and where each roller (4,6) is mounted in said recess (17) with said least two bearings (9), said bearings longitudinally spread along the length of the rollers (4,6).

9. The arrangement according to claim 1, where said rollers (4,6) are connected at the free roller ends (11) through a connection (8).

10. The arrangement according to claim 9, where said connection (8) comprises a snap-on lock for mounting in a recess around the axis of one (6) of the rollers, and a bearing on the axis of the other roller (4).

11. The arrangement according to claim 1, where said central piece (1) is a single piece.

12. The arrangement according to claim 1, where said central piece (1) comprises an essentially flat portion with a first and a second side, and where said chassis further comprises an interchangeable base plate for mounting of the central piece (1), a cover (26) adapted to at least partly enclose said first side of the central piece (1), and an interchangeable hatch adapted to at least partly enclose a second side of the central piece (1).

13. The arrangement according to claim 12, where the central piece (1) is a single piece and comprises recesses and mounting points for different printer variants.

14. The arrangement according to claim 13, further comprising a holder (3) adapted for different types and sizes of printing material and wherein said recesses and mounting points are adapted for mounting of rollers (4,6,35).

15. The arrangement according to claim 12, where the central piece (1) is a magnesium material.

16. The arrangement according to claim 12, where the printer further comprises unwind and rewind rollers for color ribbon, a sensor unit, a print mechanism and a feeding mechanism comprising said print and feed rollers (4,6), as well as an engine unit (14) for driving said unwind and rewind rollers and said print and feed rollers into rotation.

17. The arrangement according to claim 16, where the central piece (1) further comprises recesses for a suspension means (36) for a reel of printing material.

18. The arrangement according to claim 17, where the central piece (1) comprises several recesses for the suspension means (36), for adaptation to different sizes of printing material.

19. The arrangement according to claim 12, adapted for printing of labels from a paper reel, where a paper rewind roller (35) is mounted with one of its ends in the central piece (1), which paper rewind roller (35) is provided with a spring loaded shackle (38) which shackle legs running in parallel to the paper rewind roller (35) on opposite sides thereof.

20. The arrangement according to claim 19, where the shackle legs are provided with inwards projecting lips (40) and the paper rewind roller (35) is provided with recessed portions (41) in size matching said projecting lips (40), said shackle (38) being extendably anchored to the paper rewind roller (35) with a built-in spring (39), whereby said projecting lips (40) are capable of being lowered into the corresponding recessed portions (41) in a state when the shackle (38) is extended a distance along the paper rewind roller (35).

21. The arrangement according to claim 20, where a paper rewind roller for color ribbon is provided with a torsion spring clutch as a drag brake.

22. A printer comprising an arrangement according to claim 1.

23. The arrangement according to claim 1 wherein the slide bearings are ball bearings and/or roller bearings.

24. The arrangement according to claim 12 wherein the interchangeable base plate may be replaced with a second interchangeable base plate and/or the interchangeable hatch may be replaced with a second interchangeable hatch.

25. The arrangement according to claim 24 wherein the interchangeable hatch and the second interchangeable hatch have different widths and/or lengths.

26. The arrangement according to claims 24, where the interchangeable base plate and the second interchangeable base plate have different widths and/or lengths.

27. Arrangements for a printer, which printer comprises a chassis to which a print mechanism (3) as well as a feed unit comprising a print roller (4) are mounted for printing on and feeding of a printing material, characterized in that said chassis comprises a central piece (1) in which said roller (4) is mounted by one of its ends (12), whereby the other end (11) of the roller is freely suspended in relation to the chassis (1), where the axis of the roller (4), at the end which is mounted in the chassis, comprises a D-plane portion (19) for mounting of a transmission wheel with a stop screw (20), which stop screw (20) is eccentrically located in relation to the axis (19) of the roller.

* * * * *